US012467351B2

(12) United States Patent
Bordakov

(10) Patent No.: US 12,467,351 B2
(45) Date of Patent: Nov. 11, 2025

(54) SYNCHRONIZATION OF TOOL ACCELERATION VS TIME DATA AND DRILLER DEPTH VS TIME DATA

(71) Applicant: Schlumberger Technology Corporation, Sugar Land, TX (US)

(72) Inventor: George Bordakov, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 436 days.

(21) Appl. No.: 18/042,344

(22) PCT Filed: Aug. 20, 2021

(86) PCT No.: PCT/US2021/046896

§ 371 (c)(1),
(2) Date: Feb. 21, 2023

(87) PCT Pub. No.: WO2022/040520

PCT Pub. Date: Feb. 24, 2022

(65) Prior Publication Data

US 2023/0323765 A1 Oct. 12, 2023

Related U.S. Application Data

(60) Provisional application No. 63/068,414, filed on Aug. 21, 2020.

(51) Int. Cl.
*E21B 45/00* (2006.01)
*E21B 47/04* (2012.01)

(52) U.S. Cl.
CPC ..... *E21B 45/00* (2013.01); *E21B 47/04* (2013.01)

(58) Field of Classification Search
CPC ..... E21B 45/00; E21B 47/04; E21B 44/00; E21B 47/12
See application file for complete search history.

(56) References Cited

U.S. PATENT DOCUMENTS 4,047,430 A * 9/1977 Angehrn ..... E21B 47/00 73/152.16
2010/0313646 A1* 12/2010 Mehta ..... E21B 47/00 73/152.54

(Continued)

FOREIGN PATENT DOCUMENTS

WO WO-2008070754 A1 * 6/2008 ..... G01V 1/42
WO 2008070754 B1 7/2008

OTHER PUBLICATIONS

Extended Search Report issued in European Patent Application No. 21859195.6 dated Aug. 19, 2024, 9 pages.

(Continued)

*Primary Examiner* — Douglas Kay
(74) *Attorney, Agent, or Firm* — Jeffrey D. Frantz

(57) ABSTRACT

Processes and systems for synchronizing driller depth data as a function of time with downhole tool acceleration data as a function of time. In some embodiments, the process can include determining one or more in slips conditions for a drill pipe; determining one or more in slips conditions for a downhole tool; interpolating the in slips status indicators on to a common time grid; determining one or more shifts for which an allowed minimum overlapping time period between the acceleration data and the driller depth data is not less than an allowed minimum overlapping time period; determining a correlation coefficient between the interpolated in slips status indicators for each of the one or more shifts; determining a maximum correlation coefficient and a time shift associated with the maximum correlation; and synchronizing the acceleration data and the driller depth data.

19 Claims, 4 Drawing Sheets

(56) References Cited

U.S. PATENT DOCUMENTS

| | | | | |
|---|---|---|---|---|
| 2013/0341091 | A1* | 12/2013 | Sugiura | E21B 45/00 175/24 |
| 2016/0076354 | A1* | 3/2016 | Lai | G01L 3/1457 702/9 |
| 2016/0123134 | A1 | 5/2016 | Viens | |
| 2016/0334542 | A1* | 11/2016 | Chiu | G04G 7/00 |
| 2017/0152741 | A1* | 6/2017 | Park | E21B 47/00 |
| 2020/0109623 | A1* | 4/2020 | Vinay | E21B 47/12 |
| 2023/0323765 | A1* | 10/2023 | Bordakov | E21B 44/00 175/40 |

OTHER PUBLICATIONS

International Search Report and Written Opinion issued in the PCT Application PCT/US2021/046896, dated Nov. 25, 2021 (10 pages).
International Preliminary Report on Patentability issued in the PCT Application PCT/2021/046896 dated Mar. 2, 2023, 7 pages.

* cited by examiner

SYNCHRONIZATION OF TOOL ACCELERATION VS TIME DATA AND DRILLER DEPTH VS TIME DATA

CROSS-REFERENCE TO RELATED APPLICATION(S)

This application is a National Stage of International Application No. PCT/US2021/046896, filed Aug. 20, 2021, which claims priority to U.S. Provisional Patent Application No. 63/068,414, filed on Aug. 21, 2020, both of which is are incorporated by reference herein.

FIELD

This disclosure generally relates to processes and systems for providing time synchronization for downhole tools.

BACKGROUND

Logging while drilling (LWD) technologies enable data collection in real-time or in a recorded mode as the drilling operations are in process. In traditional, through-bit logging it is difficult and time consuming to synchronize tool acceleration as a function of time and driller depth as a function of time. For example, synchronization of a surface clock and a downhole clock allows merging of time-depth data (from the surface system) and downhole time-measurement data (from the tools) into depth-measurement data files.

Driller depths are based on measurements of the length of drillpipe going in the hole and are typically referenced to a device for measuring the height of the kelly or top drive with respect to a fixed point. These instantaneous measurements of depth are stored with respect to time for later merging with LWD downhole-memory data. The final log can be constructed from this depth merge. However, to create the final log, time synchronization between the surface clock and the downhole clock must be performed, which can be very cumbersome, time consuming, and expensive using known techniques.

There is a need, therefore, for processes and systems to provide time synchronization between tool acceleration as a function of time and driller depth as a function of time to provide more efficient and accurate synchronization.

SUMMARY

Processes and systems for synchronizing driller depth data as a function of time with downhole tool acceleration data as a function of time are provided. In some embodiments, a process for synchronizing driller depth data as a function of time with downhole tool acceleration data as a function of time can include determining one or more in slips conditions for a drill pipe by generating one or more driller depth status indicators as a function of time from driller depth data taken that indicate the one or more in slips conditions for the drill pipe. The process can also include determining one or more in slips conditions for a downhole tool by generating one or more acceleration status indicators as a function of time from downhole tool acceleration data taken from the downhole tool that indicate the one or more in slips conditions for the downhole tool. The process can also include establishing a common time grid for the acceleration data and the driller depth data. The process can also include interpolating the in slips status indicators on to the common time grid. The process can also include selecting an allowed minimum overlapping time period for the acceleration data and the driller depth data. The process can also include determining one or more shifts for which an overlapping time period between the acceleration data and the driller depth data is not less than the allowed minimum overlapping time period. The process can also include determining a correlation coefficient between the interpolated in slips status indicators for each of the one or more shifts. The process can also include determining a maximum correlation coefficient and a time shift associated with the maximum correlation. The process can also include synchronizing the acceleration data and the driller depth data.

In some embodiments, a system for synchronizing driller depth data as a function of time with downhole tool acceleration data as a function of time can include a synchronization controller and instructions. The instructions, when executed by the synchronization controller, can cause the synchronization controller to determine one or more in slips conditions for a drill pipe by generating one or more driller depth status indicators as a function of time from driller depth data taken that indicate the one or more in slips conditions for the drill pipe. The instructions, when executed by the synchronization controller, can also cause the synchronization controller to determine one or more in slips conditions for a downhole tool by generating one or more acceleration status indicators as a function of time from downhole tool acceleration data taken from the downhole tool that indicate the one or more in slips conditions for the downhole tool. The instructions, when executed by the synchronization controller, can also cause the synchronization controller to establish a common time grid for the acceleration data and the driller depth data. The instructions, when executed by the synchronization controller, can also cause the synchronization controller to interpolate the in slips status indicators on to the common time grid.

The instructions, when executed by the synchronization controller, can also cause the synchronization controller to select an allowed minimum overlapping time period for the acceleration data and the driller depth data. The instructions, when executed by the synchronization controller, can also cause the synchronization controller to determine one or more shifts for which the allowed minimum overlapping time period between the acceleration data and the driller depth data is not less than the allowed minimum overlapping time period. The instructions, when executed by the synchronization controller, can also cause the synchronization controller to determine a correlation coefficient between the interpolated in slips status indicators for each of the one or more shifts. The instructions, when executed by the synchronization controller, can also cause the synchronization controller to determine a maximum correlation coefficient and a time shift associated with the maximum correlation. The instructions, when executed by the synchronization controller, can also cause the synchronization controller to synchronize the acceleration data and the driller depth data.

In some embodiments, a process for synchronizing driller depth data as a function of time with downhole tool acceleration data as a function of time can include drilling a borehole with a drill string that can include a drill pipe and a downhole tool into a subterranean formation; acquiring driller depth data as a function of time while the borehole is drilled with the drill string or while the drill string is retrieved from the borehole after drilling the borehole; time stamping the acquired driller depth data; acquiring acceleration data imparted on the downhole tool with one or more sensors; and time stamping the acquired acceleration data. The process can also include determining one or more in slips conditions for the drill pipe by generating one or more driller depth status indicators as a function of time from the driller depth data that indicate the one or more in slips conditions for the drill pipe and determining one or more in slips conditions for the downhole tool by generating one or more acceleration status indicators as a function of time from the acceleration data that indicate the one or more in slips conditions for the downhole tool. The process can also include establishing a common time grid for the acceleration data and the driller depth data; interpolating the in slips status indicators on to the common time grid; and selecting an allowed minimum overlapping time period for the acceleration data and the driller depth data. The process can also include determining one or more shifts for which the allowed minimum overlapping time period between the acceleration data and the driller depth data is not less than the allowed minimum overlapping time period; determining a correlation coefficient between the interpolated in slips status indicators for each of the one or more shifts; determining a maximum correlation coefficient and a time shift associated with the maximum correlation; and synchronizing the acceleration data and the driller depth data.

BRIEF DESCRIPTION OF THE DRAWINGS

The subject disclosure is further described in the detailed description which follows, in reference to the noted Figures by way of non-limiting examples of the subject disclosure, in which like reference numerals represent similar parts throughout the several views of the drawings, and wherein.

DETAILED DESCRIPTION

Figure 1:
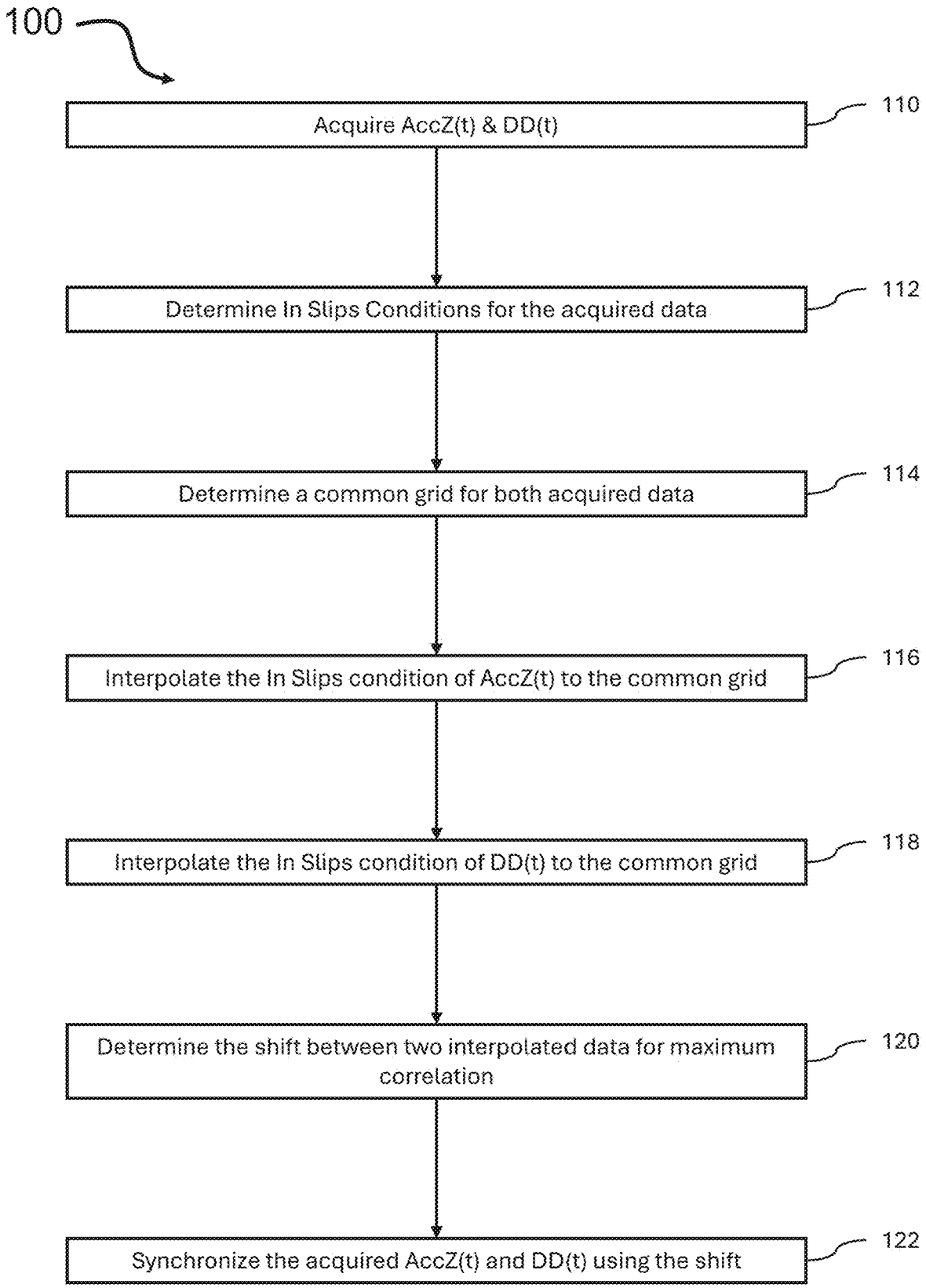
FIG. 1 depicts an illustrative process for synchronizing driller depth data as a function of time with downhole tool acceleration data as a function of time, according to one or more embodiments described.

The particulars shown herein are by way of example and for purposes of illustrative discussion of the examples of the subject disclosure only and can be presented in the cause of providing what might be the most useful and readily understood description of the principles and conceptual aspects of the subject disclosure. The description taken with the drawings making apparent to those skilled in the art how the several forms of the subject disclosure can be embodied in practice.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would be a routine undertaking of design, fabrication, and manufacture for those of ordinary skill having the benefit of this disclosure.

In one or more embodiments, a process for synchronizing driller depth data as a function of time with downhole tool acceleration data as a function of time can include retrieving data from a well string during and/or after drilling. A borehole can be drilled with a drill string that includes a drill pipe and a downhole tool into a subterranean formation. The driller depth data can be acquired as a function of time while the borehole is drilled with the drill string or while the drill string is retrieved from the borehole after drilling the borehole. The acquired driller depth data can be time stamped, e.g., with a surface clock. Acceleration data can be imparted on the downhole tool and can be acquired via one or more sensors. The acquired acceleration data can be time stamped, e.g., with a downhole clock.

The acceleration data can be or can include acceleration data from accelerations of the downhole tool along the tool axis. In some embodiments, the data can be retrieved from a through-bit logging tool that is operatively disposed in a drilling string. In some embodiments, the data can be retrieved from a memory operatively associated with the through-bit logging tool after the through-bit logging tool has been brought to the surface or can be retrieved in real-time at the surface.

The data can include acceleration data, projected or otherwise imparted onto the through-bit logging tool (referred to herein as "AccZ"), as a function of time. The data can also include driller depth data as a function of time (referred to herein as "DD"). The DD can be acquired from a drilling rig system. The data can also include any other data collected as a function of time by the through-bit logging tool or any other tool or sensor utilized while drilling. In some embodiments, the AccZ can be measured by one or more sensors. Suitable sensors can be or can include, but are not limited to, one or more accelerometers, one or more gamma ray devices, one or more resistivity measurement sensors, one or more other sensors, or any combination thereof. The one or more sensors can be operatively associated with the through-bit logging tool that is in communication with a processor, the memory at the surface, the memory on the through-bit logging tool, or combinations thereof. In some embodiments, the AccZ can be measured by the one or more sensors and the measured acceleration data can be sent to memory, time stamped, and stored for later download to the processor and/or memory located at the surface. In other embodiments, the one or more sensors can send the acquired AccZ with a time stamp to the processor and/or memory at the surface in real-time. After data acquisition, time synchronization between the AccZ and the DD can be performed as described generally below.

The process for time synchronization can include determining in slips and/or out of slips conditions of the drill pipe and acceleration indications. The term "in slips" refers to a period of time the drill pipe is not moving and/or acceleration is not indicated and the term "out of slips" refers to a period of time the drill pipe is moving and/or acceleration is indicated. One or more status indicators (herein referred to for AccZ as "AccZInSlips" and for DD as "DDInSlips") can be determined as a function of time to indicate the in slips conditions for AccZ and DD as a function of time and/or one or more status indicators (herein referred to for AccZ as "AccZOutOfSlips" and for DD as "DDOutOfSlips") can be determined as a function of time to indicate the out of slips conditions for AccZ and DD as a function of time.

The process can also include establishing a common time grid for AccZ and DD data and interpolating the in slips status indicators and/or the out of slips status indicators on to the common time grid (herein referred to respectively for AccZ as "AccZInSlipsIntrp", "AccZOutofSlipsIntrp" and for DD as "DDInSlipsIntrp", "DDOutOfSlipsIntrp"), using for example a closest point interpolation process. The process can also include selecting an allowed minimum overlapping time period for the AccZ and DD records (referred to herein as "MinSecondsOverlap"), determining one or more shifts for which the time overlap between AccZ and DD data is not less than MinSecondsOverlap, determining a correlation coefficient between AccZInSlipsIntrp and DDInSlipsIntrp for each of the one or more shifts, determining a maximum correlation coefficient and a time shift associated with the maximum correlation, and synchronizing the acceleration data and the driller depth data by shifting the acceleration data and/or the driller depth data utilizing the time shift associated with the maximum correlation coefficient.

The one or more status indicators AccZInSlipsIntrp and DDInSlipsIntrp can be generated as binary indicators where each of the one or more indicators represent states of either in slips (non-moving or unchanging) or out of slips condition (moving or changing). For example, for those times where flat line acceleration does not change and the derivative of the acceleration is zero, the AccZInSlipsIntrp can be set to "0." For those times where acceleration does change and the derivative of the acceleration is greater than zero, the AccZInSlipsIntrp can be set to "1." Similarly for DD, where flat line driller depth does not change and the derivative of the driller depth is zero, the DDInSlipsIntrp can be set to zero. For those times where flat line driller depth does change and the derivative of the driller depth is above zero, the DDInSlipsIntrp can be set to 1.

In one or more embodiments, determining the in slips status indicator for AccZ as a function of time can include calculating the absolute value of the derivative of the AccZ as a function of time (referred to herein as "AbsDerAccZ"). The process can also include building a histogram of the AbsDerAccZ values to select those derivatives that are either zero or within a threshold away from zero. For example, one or more 90th percentiles of the AbsDerAccZ values can be determined. For each of the one or more 90th percentiles, a 90th percentile absolute value of the AbsDerAccZ values can be generated (referred to herein as "AbsDerAccZP90"). Values of AbsDerAccZP90 between zero and a first threshold value can be selected (referred to herein as "AbsDerAccZP90Cutoff") as those times where the AccZ are in an in slips condition. Other percentiles can be selected for determining the first threshold values for those times where the AccZ are in an in slips condition. For example, 25th, 30th, 35th, 40th, 45th, 50th, 55th, 60th, 65th, 70th or higher or lower percentiles can be selected as well as percentiles therebetween. The first threshold value can be a number greater than zero, e.g., 0.05, 0.01, 0.015, 0.02, 0.1, 0.15, 0.20, or any other number that one skilled in the art would understand with the aid of this disclosure. The first threshold value can be any number greater than zero and less than 1.

In one or more embodiments, determining the in slips status indicator for AccZ as a function of time can include generating a raw slips indicator (referred to herein as "AccZInSlipsRaw") according to the following, where all values below the first threshold value are considered to be in an in slips condition:

a. AccZInSlipsRaw equals 1 if AbsDerAccZ is not 0 and is less than AbsDerAccZP90Cutoff*AbsDerAccZP90; and
b. AccZInSlipRaw equals 0 if the conditions in (a) are not met. For example, if AbsDerAccZ is equal to 0, then the AccZInSlipRaw equals 0; or if AbsDerAccZ is equal to or greater than AbsDerAccZP90Cutoff*AbsDerAccZP90, then AccZInSlipRaw equals 0.

The process can also include selecting one or more minimum durations of in slips intervals (referred to herein as "MinInSlipsSeconds"). The MinInSlipsSeconds can be from 1 second, 2 seconds, 3 seconds, 4 seconds, 5 seconds, 6 seconds, 7 seconds, 8 seconds, 9 seconds, 10 seconds, 12 seconds, 13 seconds, 1 minute, 2 minutes, or any other interval the one skilled in the art would know with the aid of this disclosure. The MinInSlipsSeconds can be selected by an operator, can be predetermined an inputted prior to running the job, or inputted by an operator. The process can also include selecting one or more minimum durations of out of slips interval (referred to herein as "MinOutOfSlipsSeconds"). The MinOutOfSlipsSeconds can be from 1 second, 2 seconds, 3 seconds, 4 seconds, 5 seconds, 6 seconds, 7 seconds, 8 seconds, 9 seconds, 10 seconds, 12 seconds, 13 seconds, 1 minute, 2 minutes, or any other interval the one skilled in the art would know with the aid of this disclosure. The MinOutOfSlipsSeconds can be selected by an operator, can be predetermined an inputted prior to running the job, or inputted by an operator.

The in slips indicator for AccZ (referred to herein as "AccZInSlips") can be calculated by filtering AccZInSlipsRaw according to the following:

a. AccZInSlips equals 1 for time intervals where AccZInSlipsRaw equals 1 that have a duration that is equal to or greater than MinInSlipsSeconds, and AccZInSlips equals 1 for time intervals where AccZInSlipsRaw equals 0 that have a duration that is less than MinOutOfSlipsSeconds; and
b. AccZInSlips equals 0 where time intervals for AccZInSlipsRaw equals 0 that are equal to or greater than MinOutOfSlipsSeconds, and AccZInSlips equals 0 for time intervals where AccZInSlipsRaw equals 1 that have a duration that is less than MinInSlipsSeconds.

In one or more embodiments, determining the in slips status indicator for DD as a function of time can include calculating the absolute value of the derivative of the DD as a function of time (referred to herein as "AbsDerDD"). The process can also include building a histogram of AbsDerDD values to select those derivatives that are either zero or within a threshold away from zero. For example, one or more 90th percentiles of the AbsDerDD values can be determined. For each of the one or more 90th percentiles, a 90th percentile absolute value of the AbsDerDD values can be generated (referred to herein as "AbsDerDDP90"). Values of AbsDerDDP90 between zero and a second threshold value can be selected (referred to herein as "AbsDerDDP90Cutoff") as those times where the DD are in an in slips condition. Other percentiles can be selected for determining the second threshold values for those times where the DD are in an in slips condition. For example, 25th, 30th, 35th, 40th, 45th, 50th, 55th, 60th, 65th, 70th or higher or lower percentiles can be selected as well as percentiles therebetween. The second threshold value can be a number greater than zero, e.g., 0.05, 0.01, 0.015, 0.02, 0.1, 0.15, 0.20, or any other number that one skilled in the art would understand with the aid of this disclosure. The second threshold value can be any number greater than zero and less than 1 and the first threshold value can be equal to the second threshold value but does not need to be.

In one or more embodiments, determining the in slips status indicator for DD as a function of time can include generating a raw slips indicator (referred to herein as "DDInSlipsRaw") according to the following, where all values below the second threshold value are considered to be in an in slips condition:

a. DDInSlipsRaw equals 1 if AbsDerDD is not 0 and is less than AbsDerDDP90Cutoff*AbsDerDDP90; and
b. DDInSlipsRaw equals 0 if the conditions in (a) are not met. For example, if AbsDerDD is equal to 0, then the DDInSlipsRaw equals 0; or if AbsDerDD is less than AbsDerDDP90Cutoff*AbsDerDDP90, then DDInSlipsRaw equals 0.

The process can also include selecting one or more minimum durations of in slips intervals for DD (referred to herein as "MinInSlipsSecondsDD"). The MinInSlipsSecondsDD can be from 1 second, 2 seconds, 3 seconds, 4 seconds, 5 seconds, 6 seconds, 7 seconds, 8 seconds, 9 seconds, 10 seconds, 12 seconds, 13 seconds, 1 minute, 2 minutes, or any other interval the one skilled in the art would know with the aid of this disclosure. The MinInSlipsSecondsDD can be selected by an operator, can be predetermined an inputted prior to running the job, or inputted by an operator. The MinInSlipsSecondsDD can be equal to the MinInSlipsSeconds selected for AccZ as above. The process can also include selecting one or more certain minimum duration of out of slips interval (referred to herein as "MinOutOfSlipsSecondsDD"). The MinOutOfSlipsSecondsDD can be from 1 second, 2 seconds, 3 seconds, 4 seconds, 5 seconds, 6 seconds, 7 seconds, 8 seconds, 9 seconds, 10 seconds, 12 seconds, 13 seconds, 1 minute, 2 minutes, or any other interval the one skilled in the art would know with the aid of this disclosure. The MinOutOfSlipsSecondsDD can be selected by an operator, can be predetermined an inputted prior to running the job, or inputted by an operator. The MinOutOfSlipsSecondsDD can be equal to the MinOutOfSlipsSeconds selected for AccZ as above.

The in slips indicator for DD (referred to herein as "DDInSlips") can be calculated by filtering DDInSlipsRaw according to the following:

a. DDInSlips equals 1 for time intervals where DDInSlipsRaw equals 1 that have a duration that is equal to our greater than MinInSlipsSecondsDD, and DDInSlips equals 1 for time intervals where DDInSlipsRaw equals 0 that have a duration that is less than MinOutOfSlipsSecondsDD; and
b. DDInSlips equals 0 where time intervals for DDInSlipsRaw equals 0 that are equal to or greater than MinOutOfSlipsSecondsDD, and DDInSlips equals 0 for time intervals where DDInSlipsRaw equals 1 that have a duration that is less than MinInSlipsSecondsDD.

The process can further include establishing a common time grid for AccZ and DD. The common time grid can be a regular grid overlapping both AccZ and DD data with a sampling rate that is maximum of a median distance between adjacent time samples in AccZ time record (referred to herein as "AccZdT") and a sampling rate of a median distance between adjacent samples in DD time record (referred to herein as DDdT). The sampling rate can be snapped to the close multiple of a second or a whole fraction of a second.

In one or more embodiments, AccZInSlips can be interpolated on to the common time grid using for example a nearest neighbor process to determine AccZInSlipsIntrp. Similarly, DDInSlips can be interpolated on to the common time grid using, for example a nearest neighbor process, to determine DDInSlipsIntrp.

The process can also include selecting a minimum time overlap for AccZ and DD as a function of time (referred to herein as "MinSecondsOverlap") to determine a shift between AccZInSlipsIntrp and DDInSlipsIntrp for which maximum correlation coefficient is achieved. The MinSecondsOverlap can be a predetermined value, a user provided value, or a derived value. The MinSecondsOverlap can be any time interval. For example, MinSecondsOverlap can be 10,000 seconds, 20,000 seconds, 30,000 seconds, or other values one skilled in the art would know how to determine with the aid of this disclosure. To determine the shift between AccZInSlipsIntrp and DDInSlipsIntrp for which maximum correlation coefficient is achieved, all shifts for which the time overlap between AccZ and DD as a function of time is not less than MinSecondsOverlap are considered. The shift with the maximum correlation coefficient can be determined by calculating all the correlation coefficients for all possible shifts on the common grid. The identified shift with the maximum correlation coefficient can be the shift used for time synchronization between the AccZ and DD data as a function of time to align the data for further analysis. All intermediate results above may be used for quality control, including the correlation coefficient as a function of shift and the interpolated in slips status indicators.

FIG. 1 depicts an illustrative process 100 for synchronizing driller depth data as a function of time with downhole tool acceleration data as a function of time, according to one or more embodiments described. The process 100 can include acquiring and providing AccZ as a function of time data and DD as a function of time data to a processor, action 110. The process can further include determining the AccZInSLips and DDInSlips, action 112. The process can also include determining a common grid overlapping both AccZ and DD data with a sampling rate that is a maximum of AccZdT and DDdT, action 114.

The process can also include determining AccZInSlipsIntrp, action 116. Further, the process can include determining DDInSlipsIntrp, action 118. The process can further include utilizing the MinSecondsOverlap to determine the shift between AccZInSlipsIntrp and DDInSlipsIntrp for which maximum correlation coefficient is achieved, action 120. The process can further include synchronizing the data for AccZ as a function of time and the data for DD as a function of time by shifting the data using the shift with the maximum correlation coefficient, action 122.

Figure 2:
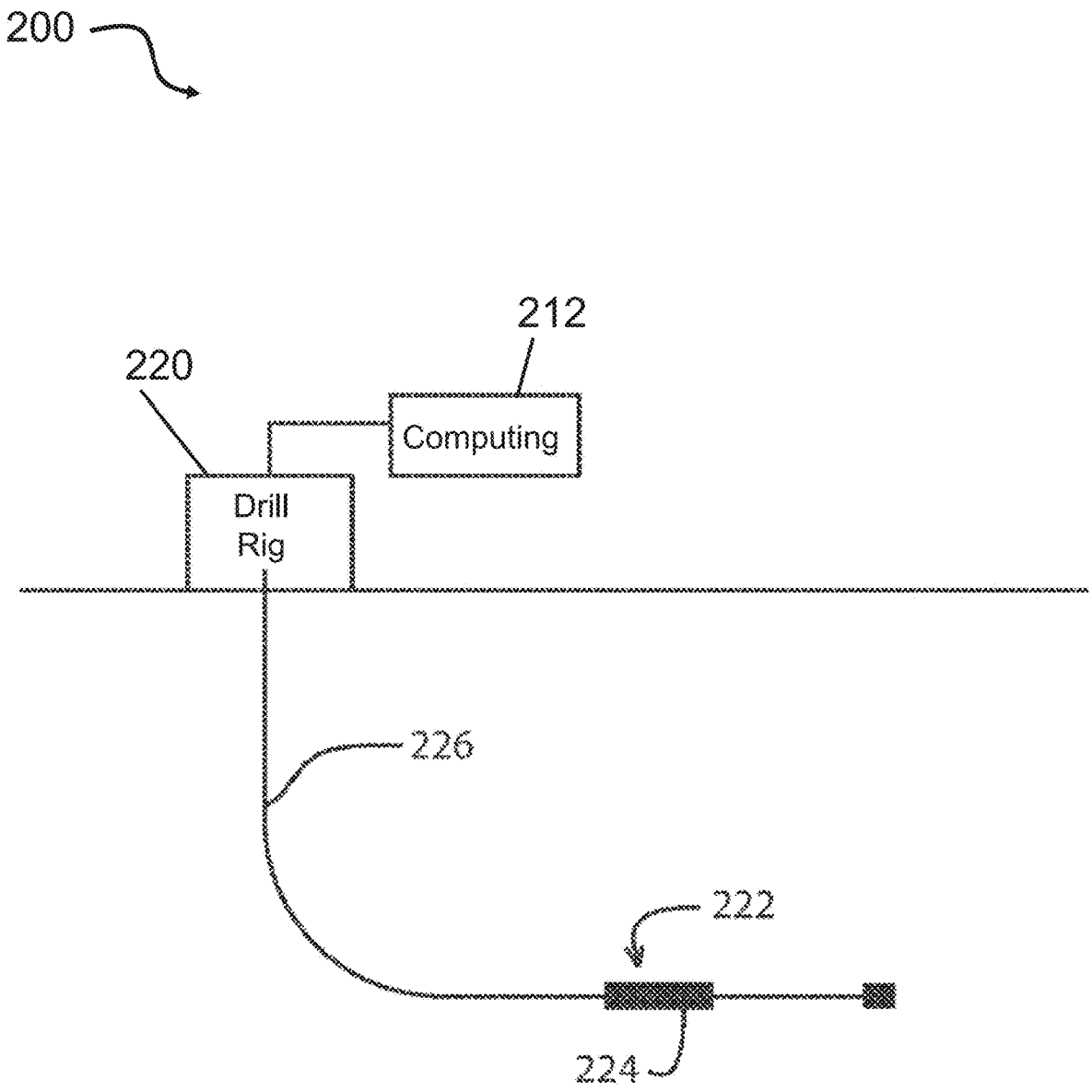
FIG. 2 depicts a schematic of an illustrative drill rig system, according to one or more embodiments described.

FIG. 2 depicts a schematic of an illustrative drill rig system 200, according to one or more embodiments. In one or more embodiment, the drill rig system 200 can include a drill rig system 220 that can be configured to acquire and stamp driller depth data as a function of time and a drill string 226 that can be retrieved with a downhole tool 222 located therein. The system can also include a sensor 224 operatively connected to the downhole tool 222 for acquiring acceleration data imparted on the downhole tool 222 as the drill string 226 is retrieved, and wherein the sensor or a processor and memory in the downhole tool 222 can be configured to time stamp the data to provide acceleration as a function of time data.

The acceleration as a function of time data can be provided to a computing system 212 in real-time or stored in memory of the downhole tool and uploaded into the computing system 212 after the downhole tool is retrieved. In one or more embodiments, the drill rig system can be in communication with the computing system 212 and provide driller depth as a function of time data to the computing system 212 in real-time. In other embodiments, drill depth as a function of time data acquired by the drill rig system 200 can be provided to the computing system 212 after the job is complete, for example, a flash drive or network connection can be retrieve driller depth as a function of time data from memory in the rig system and transfer the driller depth as a function of time data to the computing system 212 after the downhole is retrieved from the surface.

Figure 3:
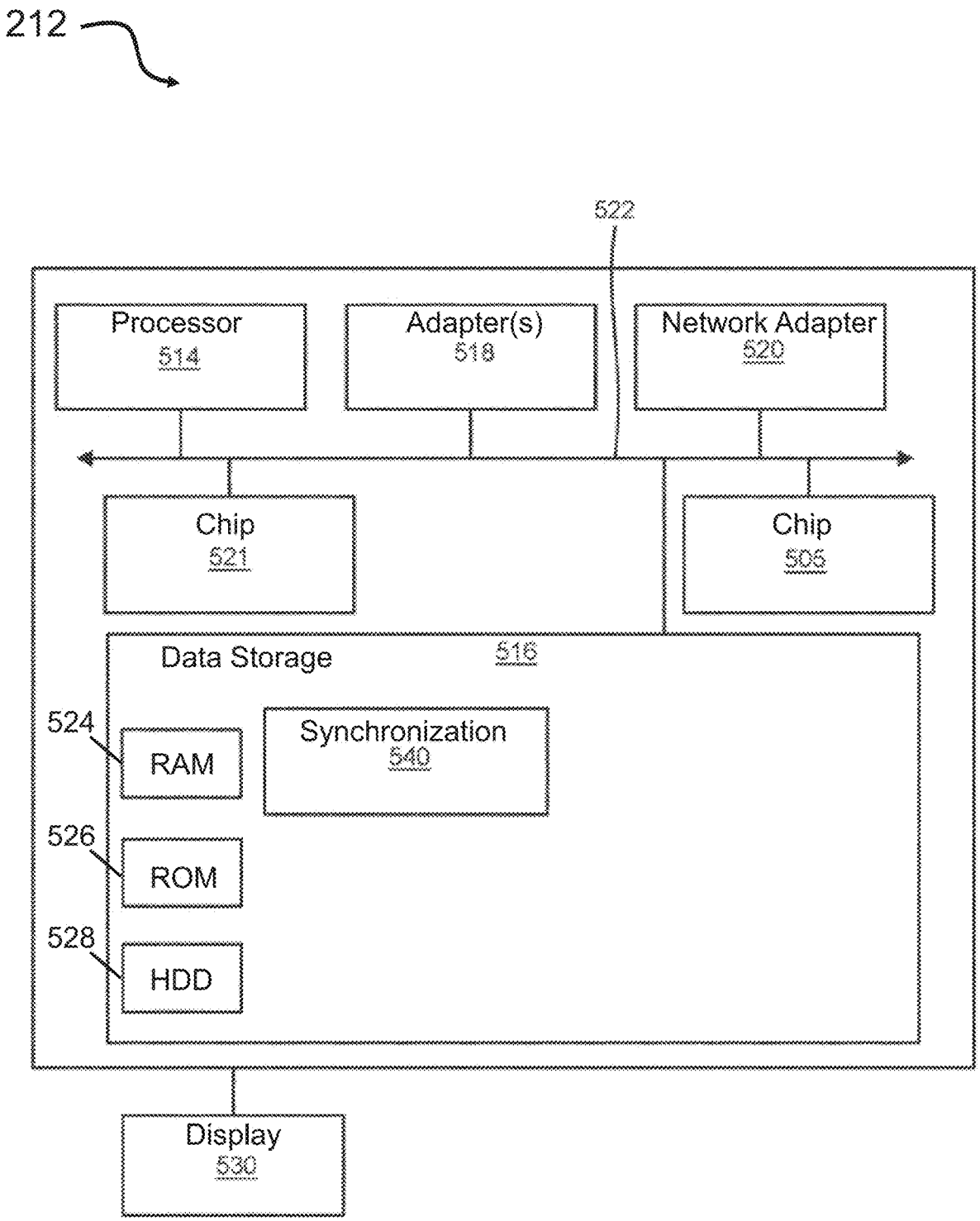
FIG. 3 depicts a schematic of an illustrative computing system for performing time synchronization between driller depth data as a function of time and downhole tool acceleration data as a function of time, according to one or more embodiments described.

FIG. 3 depicts a schematic of an illustrative computing system 212 for performing time synchronization between driller depth data as a function of time and downhole tool acceleration data as a function of time, according to one or more embodiments. One or more chips, for example chips 505 and/or 521, can be or can include field-programmable gate arrays ("FPGAs"), application specific integrated circuits ("ASICs"), chiplets, Multi-Chip-Modules, central processing units ("CPUs"), and/or system-on-chips ("SOCs"), to name a few. The chip can be used in a wide-range of applications, including but not limited to auto emission control, environmental monitoring, digital voice recorders, or other digital processing systems. ASICs can include entire microprocessors, memory blocks including read only memory (ROM), random access memory (RAM), erasable programmable read only memory (EPROM), electrically erasable programmable read only memory (EEPROM), flash memory and other building blocks and can be known as system-on-chip ("SoC").

To achieve its desired functionality, the computing system 212 can include various hardware and software components. Among these components can be one or more processors 514 and a synchronization controller 540. These hardware components can be interconnected through the use of a number of electrical connections, busses, and/or network connections. In one embodiment, the processor 514, the chip 505, the chip 521, and the synchronization controller 540 can be communicatively coupled via a bus 522. The bus 522 can be or include any know computing system bus. The synchronization controller 540 can be internal to a data storage device 516.

The chip 505, the chip 521, and/or the synchronization controller 540 can include, either separately or in some combination, the necessary software and hardware, including tangible, non-transitory computer readable medium (not shown), for performing time synchronization between well logs. The synchronization controller 540 can be integrated into or be the chip 505, the chip 521, and/or the processor 514, or can be software. The chip 505 and/or the chip 521 can be integrated into the processor 514. Although synchronization controller 540 is depicted as being internal to the data storage device 516, in other examples, the controller module 534 can be a peripheral device (not shown) coupled to the computing system 212 or included within a peripheral device (not shown) coupled to the computing system 212. In other examples, the synchronization controller 540 can be a peripheral device (not shown) coupled to the computing system 212 or included within a peripheral device (not shown) coupled to the computing system 212.

The synchronization controller 540 can include instructions that when executed by the synchronization controller 540 can cause the synchronization controller 540 to perform time synchronization between two or more well logs. Referring to FIG. 1, the instructions can, when executed by the synchronization controller 540, cause the synchronization controller 540 to implement at least the functionality of acquiring and providing Accz as a function of time data and DD as a function of time data to the processor 514 or the synchronization controller 540, action 110. Determining the AccZInSLips and DDInSlips, action 112. The instructions can further include determining a common grid overlapping both AccZ and DD data with a sampling rate that is the maximum of AccZdT and DDdT, action 114. The instructions can further include determining AccZInSlipsIntrp, action 116 and determining DDInSlipsIntrp, action 118. The instructions can further include utilizing the MinSecondsOverlap to determine the shift between AccZInSlipsIntrp and DDInSlipsIntrp for which maximum correlation coefficient is achieved, action 120. The instructions can further include synchronizing the data for AccZ as a function of time and the data for DD as a function of time by shifting the data using the shift with the maximum correlation coefficient, action 122. The instructions can, when executed by the synchronization controller 540, cause the synchronization controller 540 to output a graphical representation of the synchronized data for visual inspection and other analyses. Returning to FIG. 3, in examples the synchronization controller 540 can work in conjunction with the processor 514 to implement the functionality described above. In examples, the synchronization controller 540 can execute firmware code stored on the computing system 212, such as on the chip 505, the chip 521, and/or the processor 514. The functionality of the computing system 212 and/or the synchronization controller 540 can be in accordance with the processes of the present specification described herein. In the course of executing code, the processor 514 and/or the synchronization controller 540 can receive input from and provide output to a number of the remaining hardware units.

The computing system 212 can be implemented in an electronic device. Examples of electronic devices include servers, desktop computers, laptop computers, cloud-based computers, personal digital assistants ("PDAs"), mobile devices, smartphones, gaming systems, and tablets, among other electronic devices. The computing system 212 can be utilized in any data processing scenario including, standalone hardware, mobile applications, through a computing network, or combinations thereof. Further, the computing system 212 can be used in a computing network, a public cloud network, a private cloud network, a hybrid cloud network, other forms of networks, or combinations thereof. In one example, the processes provided by the computing system 212 are provided as a service by a third party.

To achieve its desired functionality, the computing system 212 can include various other hardware components. Among these other hardware components can be a number of data storage devices or tangible, non-transitory computer readable medium 516, a number of peripheral device adapters 518, and a number of network adapters 520. These hardware components can be interconnected through the use of a number of electrical connections, busses, and/or network connections. In one example, the processor 514, data storage device 516, peripheral device adapters 518, and a network adapter 520 can be communicatively coupled via a bus, for example the bus 522 as depicted in FIG. 3 or via a separate bus, not shown.

The chip 505, the chip 521, and/or the processor 514 can include the hardware and/or firmware/software architecture to retrieve executable code from the data storage device 516 and execute the executable code. The executable code can, when executed by the chip 505, the chip 521, and/or the processor 514, cause the chip 505, the chip 521, and/or the processor 514 to implement at least the functionality of determining the AccZInSLips and DDInSlips, action 112; determining a common grid overlapping both AccZ and DD data with a sampling rate that is the maximum of AccZdT and DDdT, action 114; determining AccZInSlipsIntrp, action 116; determining DDInSlipsIntrp, action 118; utilizing the MinSecondsOverlap to determine the shift between AccZInSlipsIntrp and DDInSlipsIntrp for which maximum correlation coefficient is achieved, action 120; and synchronizing the data for AccZ as a function of time and the data for DD as a function of time by shifting the data using the shift with the maximum correlation coefficient, action 122.

The data storage device 516 can store data such as executable program code that is executed by the processor 514, the synchronization controller 540, or other processing devices. The processor 514 can be a central processing unit that is to execute an operating system in the computing system 212. As will be discussed, the data storage device 516 can specifically store computer code representing a number of applications that the processor 514 and/or the synchronization controller 540 can execute to implement at least the functionality described herein.

The data storage device 516 can include various types of memory modules, including volatile and nonvolatile memory. For example, the data storage device 516 of the present example can include Random Access Memory ("RAM") 524, Read Only Memory ("ROM") 526, and Hard Disk Drive ("HDD") storage 528. Many other types of memory can also be utilized, and the present specification contemplates the use of many varying type(s) of memory in the data storage device 516 as can suit a particular application of the principles described herein. In certain examples, different types of memory in the data storage device 516 can be used for different data storage needs. For example, in certain examples the processor 514 can boot from Read Only Memory ("ROM") 526, maintain nonvolatile storage in the Hard Disk Drive ("HDD") memory 528, and execute program code stored in Random Access Memory ("RAM") 524. In examples, the chip 505, and the chip 521 can boot from the Read Only Memory ("ROM") 526.

The data storage device 516 can include a computer readable medium, a computer readable storage medium, or a non-transitory computer readable medium, among others. For example, the data storage device 516 can be, an electronic, magnetic, optical, electromagnetic, infrared, or semiconductor system, apparatus, or device, or any suitable combination of the foregoing. More specific examples of the computer readable storage medium can include, for example, the following: an electrical connection having a number of wires, a portable computer diskette, a hard disk, a RAM, a ROM, an EPROM, a Flash memory, a portable compact disc read-only memory ("CD-ROM"), an optical storage device, a magnetic storage device, or any suitable combination of the foregoing. In the context of this document, a computer readable storage medium can be any tangible medium that can contain, or store computer usable program code for use by or in connection with an instruction execution system, apparatus, or device. In another example, a computer readable storage medium can be any non-transitory medium that can contain or store a program for use by or in connection with an instruction execution system, apparatus, or device.

The hardware adapters 518, 520 in the computing system 212 can enable the processor 514 to interface with various other hardware elements, external and internal to the computing system 212. For example, the peripheral device adapters 518 can provide an interface to input/output devices, such as, for example, a display device 530, a mouse, and/or a keyboard. The peripheral device adapters 518 can also provide access to other external devices such as an external storage device, a number of network devices such as, for example, servers, switches, and routers, client devices, other types of computing devices, and combinations thereof.

The display device 530 can be provided to allow a user of the computing system 212 to interact with and implement the functionality of the computing system 212. Examples of display devices 530 can include a computer screen, a laptop screen, a mobile device screen, a personal digital assistant ("PDA") screen, and/or a tablet screen, among other display devices 530.

The peripheral device adapters 518 can also create an interface between the processor 514 and the display device 530, a printer, or other media output devices. The network adapter 520 can provide an interface to other computing devices within, for example, a network, thereby enabling the transmission of data between the computing system 212 and other devices located within the network. The network adapter 520 can provide an interface to an external telecommunications network such as a cellular phone network or other radio frequency enabled network, thereby enabling the transmission of data between the computing system 212 and other external devices such as an external storage device, a number of network devices such as, for example, servers, switches, and routers, client servers, radio frequency enabled devices, other client devices, other types of computing devices, and combinations thereof.

The computing system 212 can further includes a number of modules used in the implementation of the systems and processes described herein. The various modules within the computing system 212 can include executable program code that can be executed separately. In this example, the various modules can be stored as separate computer program products. In another example, the various modules within the computing system 212 can be combined within a number of computer program products; each computer program product including a number of the modules.

Figure 4:
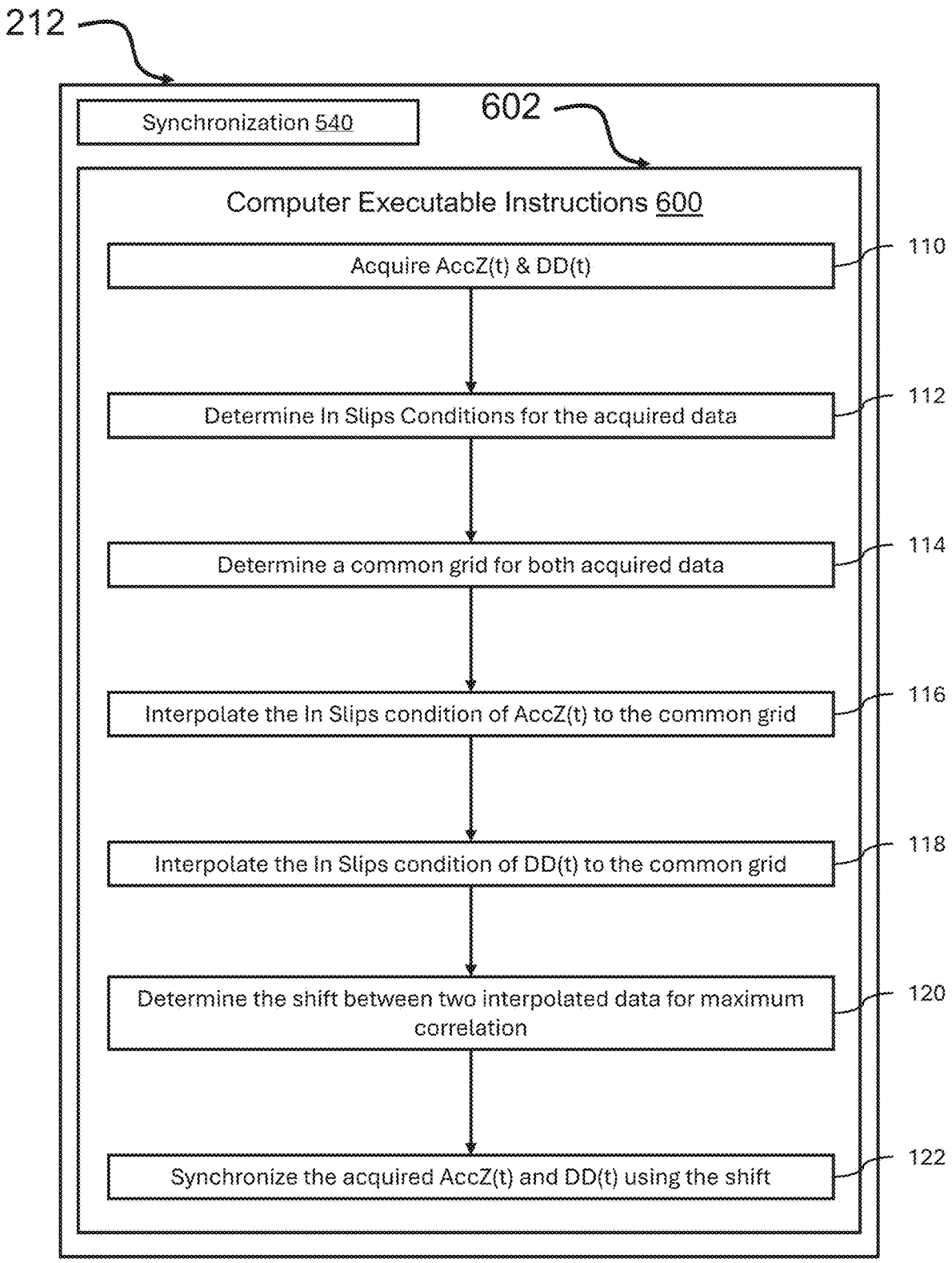
FIG. 4 depicts an illustrative computing device that includes a synchronization controller and a non-transitory computer-readable medium that includes computer executable instructions stored thereon within the computing system of FIG. 3, according to one or more embodiments described.

FIG. 4 depicts an illustrative computing device including the synchronization controller 540 and a non-transitory computer-readable medium 602 including computer executable instructions 600 stored thereon within the computing system of FIG. 3, according to one or more embodiments. When the computer executable instructions 600 are executed by the synchronization controller 540, the computer executable instructions 600 can cause the synchronization controller 540 to implement at least the functionality of determining the AccZInSLips and DDInSlips, block 112; determining a common grid overlapping both AccZ and DD data with a sampling rate that is the maximum of AccZdT and DDdT, block 114; determining AccZInSlipsIntrp, block 116; determining DDInSlipsIntrp, block 118; utilizing the MinSecondsOverlap to determine the shift between AccZInSlipsIntrp and DDInSlipsIntrp for which maximum correlation coefficient is achieved, block 120; and synchronizing the data for AccZ as a function of time and the data for DD as a function of time by shifting the data using the shift with the maximum correlation coefficient, block 122. The computer executable instructions 600 can cause the synchronization controller 540 to output a graphical representation of the synchronized data for visual inspection and other analyses.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Although only a few examples have been described in detail above, those skilled in the art will readily appreciate that many modifications can be possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw can be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A process for synchronizing driller depth data as a function of time with downhole tool acceleration data as a function of time, the process comprising:

drilling a borehole with a drill string comprising a drill pipe and a downhole tool into a subterranean formation;

acquiring driller depth data as a function of time while the borehole is drilled with the drill string or while the drill string is retrieved from the borehole after drilling the borehole;

time stamping the acquired driller depth data;

acquiring acceleration data imparted on the downhole tool with one or more sensors;

time stamping the acquired acceleration data;

determining one or more in slips conditions for a drill pipe by generating one or more driller depth status indicators as a function of time from driller depth data taken that indicate the one or more in slips conditions for the drill pipe;

determining one or more in slips conditions for a downhole tool by generating one or more acceleration status indicators as a function of time from downhole tool acceleration data taken from the downhole tool that indicate the one or more in slips conditions for the downhole tool;

establishing a common time grid for the acceleration data and the driller depth data, the common time grid overlapping both the acceleration data and the driller depth data with a sampling rate determined by a maximum of a median time distance between adjacent time samples in an acceleration data time record and a median time distance between adjacent samples in a driller depth data time record, such that the sampling rate is snapped to the closest multiple of a second or a whole fraction of a second in the time grid;

interpolating the in slips status indicators on to the common time grid;

selecting an allowed minimum overlapping time period for the acceleration data and the driller depth data;

determining one or more shifts for which an overlapping time period between the acceleration data and the driller depth data is not less than the allowed minimum overlapping time period;

determining a correlation coefficient between the interpolated in slips status indicators for each of the one or more shifts;

determining a maximum correlation coefficient and a time shift associated with the maximum correlation; and synchronizing the acceleration data and the driller depth data using the time shift associated with the maximum correlation, wherein the one or more in slips conditions for the drill pipe are determined from the driller depth data after the drilling is completed.

2. The process of claim 1, wherein synchronizing the acceleration data and the driller depth data comprises shifting the acceleration data utilizing the time shift associated with the maximum correlation coefficient.

3. The process of claim 1, wherein synchronizing the acceleration data and the driller depth data comprises shifting the driller depth data utilizing the time shift associated with the maximum correlation coefficient.

4. The process of claim 1, wherein the one or more driller depth status indicators comprise a driller depth binary indicator having a value of zero when the driller depth is unchanging and one when the driller depth is changing.

5. The process of claim 4, wherein the driller depth binary indicator has a value of zero when the driller depth data is greater than zero but less than a first threshold value and has a value of one when the driller depth data is greater than the first threshold value.

6. The process of claim 1, wherein the one or more acceleration status indicators comprise an acceleration binary indicator having a value of zero when the acceleration data is unchanging and one when the acceleration data is changing.

7. The process of claim 6, wherein the acceleration binary indicator has a value of zero when the acceleration data is greater than zero but less than a second threshold value and has a value of one when the acceleration data is greater than the second threshold value.

8. A system for synchronizing driller depth data as a function of time with downhole tool acceleration data as a function of time, comprising:

a drill rig system comprising a drill string comprising a drill pipe and a downhole tool;

drill rig system instructions that when executed by the synchronization controller cause the synchronization controller to:

drill a borehole with the drill string into a subterranean formation;

acquire driller depth data as a function of time while the borehole is drilled with the drill string or while the drill string is retrieved from the borehole after drilling the borehole;

time stamping the acquired driller depth data;

acquiring acceleration data imparted on the downhole tool with one or more sensors;

time stamping the acquired acceleration data;

a synchronization controller; and synchronization controller instructions that when executed by the synchronization controller cause the synchronization controller to:

determine one or more in slips conditions for a drill pipe by generating one or more driller depth status indicators as a function of time from driller depth data taken that indicate the one or more in slips conditions for the drill pipe;

determine one or more in slips conditions for a downhole tool by generating one or more acceleration status indicators as a function of time from downhole tool acceleration data taken from the downhole tool that indicate the one or more in slips conditions for the downhole tool;

establish a common time grid for the acceleration data and the driller depth data, the common time grid overlapping both the acceleration data and the driller depth data with a sampling rate determined by a maximum of a median time distance between adjacent time samples in an acceleration data time record and a median time distance between adjacent samples in a driller depth data time record, such that the sampling rate is snapped to the closest multiple of a second or a whole fraction of a second in the time grid;

interpolate the in slips status indicators on to the common time grid;

select an allowed minimum overlapping time period for the acceleration data and the driller depth data;

determine one or more shifts for which an overlapping time period between the acceleration data and the driller depth data is not less than the allowed minimum overlapping time period;

determine a correlation coefficient between the interpolated in slips status indicators for each of the one or more shifts;

determine a maximum correlation coefficient and a time shift associated with the maximum correlation; and synchronize the acceleration data and the driller depth data using the time shift associated with the maximum correlation.

9. The system of claim 8, wherein the synchronization controller instructions, when executed by the synchronization controller, cause the synchronization controller to synchronize the acceleration data and the driller depth data by shifting the acceleration data utilizing the time shift associated with the maximum correlation coefficient.

10. The system of claim 8, wherein the synchronization controller instructions, when executed by the synchronization controller, cause the synchronization controller to synchronize the acceleration data and the driller depth data by shifting the driller depth data utilizing the time shift associated with the maximum correlation coefficient.

11. The system of claim 8, wherein the one or more driller depth status indicators comprise a driller depth binary indicator having a value of zero when the driller depth is unchanging and one when the driller depth is changing.

12. The system of claim 11, wherein the driller depth binary indicator has a value of zero when the driller depth data is greater than zero but less than a first threshold value and has a value of one when the driller depth data is greater than the first threshold value.

13. The system of claim 9, wherein the one or more acceleration status indicators comprise an acceleration binary indicator having a value of zero when the acceleration data is unchanging and one when the acceleration data is changing.

14. The system of claim 13, wherein the acceleration binary indicator has a value of zero when the acceleration data is greater than zero but less than a second threshold value and has a value of one when the acceleration data is greater than the second threshold value.

15. A process for synchronizing driller depth data as a function of time with downhole tool acceleration data as a function of time, the process comprising:

drilling a borehole with a drill string comprising a drill pipe and a downhole tool into a subterranean formation;

acquiring driller depth data as a function of time while the borehole is drilled with the drill string or while the drill string is retrieved from the borehole after drilling the borehole;

time stamping the acquired driller depth data;

acquiring acceleration data imparted on the downhole tool with one or more sensors;

time stamping the acquired acceleration data;

determining one or more in slips conditions for the drill pipe by generating one or more driller depth status indicators as a function of time from the driller depth data that indicate the one or more in slips conditions for the drill pipe;

determining one or more in slips conditions for the downhole tool by generating one or more acceleration status indicators as a function of time from the acceleration data that indicate the one or more in slips conditions for the downhole tool;

establishing a common time grid for the acceleration data and the driller depth data, the common time grid overlapping both the acceleration data and the driller depth data with a sampling rate determined by a maximum of a median time distance between adjacent time samples in an acceleration data time record and a median time distance between adjacent samples in a driller depth data time record, such that the sampling rate is snapped to the closest multiple of a second or a whole fraction of a second in the time grid;

interpolating the in slips status indicators on to the common time grid;

selecting an allowed minimum overlapping time period for the acceleration data and the driller depth data;

determining one or more shifts for which an overlapping time period between the acceleration data and the driller depth data is not less than the allowed minimum overlapping time period;

determining a correlation coefficient between the interpolated in slips status indicators for each of the one or more shifts;

determining a maximum correlation coefficient and a time shift associated with the maximum correlation; and synchronizing the acceleration data and the driller depth data using the time shift associated with the maximum correlation.

16. The process of claim 15, wherein the one or more driller depth status indicators comprise a driller depth binary indicator having a value of zero when the driller depth is unchanging and one when the driller depth is changing.

17. The process of claim 16, wherein the driller depth binary indicator has a value of zero when the driller depth data is greater than zero but less than a first threshold value and has a value of one when the driller depth data is greater than the first threshold value.

18. The process of claim 15, wherein the one or more acceleration status indicators comprise an acceleration binary indicator having a value of zero when the acceleration data is unchanging and one when the acceleration data is changing.

19. The process of claim 18, wherein the acceleration binary indicator has a value of zero when the acceleration data is greater than zero but less than a second threshold value and has a value of one when the acceleration data is greater than the second threshold value.

* * * * *